US005705125A

United States Patent [19]

Goto et al.

[11] Patent Number: 5,705,125

[45] Date of Patent: Jan. 6, 1998

[54] WIRE FOR ELECTRIC RAILWAYS

[75] Inventors: Motoo Goto; Shizuo Kawakita, both of Tokyo; Yoshiharu Mae, Ohmiya; Takuro Iwamura; Yutaka Koshiba, both of Tokyo; Kenji Yajima, Ohmiya; Syunji Ishibashi, Kokubunji; Hiroki Nagasawa, Kokubunji; Atsushi Sugahara, Kokubunji; Sumihisa Aoki, Kokubunji; Haruhiko Asao, Tokyo, all of Japan

[73] Assignees: Mitsubishi Materials Corporation; Railway Technical Research Institute, both of Tokyo, Japan

[21] Appl. No.: 343,110

[22] Filed: Nov. 22, 1994

Related U.S. Application Data

[63] Continuation-in-part of Ser. No. 55,205, Apr. 30, 1993, abandoned.

[30] Foreign Application Priority Data

May 8, 1992 [JP] Japan ..... 4-143201
Nov. 17, 1992 [JP] Japan ..... 4-331024

[51] Int. Cl.[6] ..... C22C 9/00

[52] U.S. Cl. ..... 420/470; 420/490; 420/492; 420/495

[58] Field of Search ..... 420/470, 490, 420/492, 494, 495

[56] References Cited

U.S. PATENT DOCUMENTS

| | | | |
|---|---|---|---|
| 3,717,511 | 2/1973 | Wallbaum et al. | 148/680 |
| 4,451,430 | 5/1984 | Matidori et al. | 420/492 |
| 4,749,548 | 6/1988 | Akutsu et al. | 420/495 |
| 4,755,235 | 7/1988 | Matidori et al. | 198/682 |

FOREIGN PATENT DOCUMENTS

| | | |
|---|---|---|
| 0023362 | 2/1981 | European Pat. Off. . |
| 1578403 | 7/1969 | France . |
| 59-193233 | 11/1984 | Japan . |
| 60-194030 | 10/1985 | Japan . |
| 60-53739 | 11/1985 | Japan . |
| 63-3936 | 1/1988 | Japan . |
| 63-125631 | 5/1988 | Japan . |
| 63-149344 | 6/1988 | Japan . |
| 63-303020 | 12/1988 | Japan . |
| 64-62428 | 3/1989 | Japan . |
| 2-170932 | 7/1990 | Japan . |
| 3-56632 | 3/1991 | Japan . |
| 3-56633 | 3/1991 | Japan . |

OTHER PUBLICATIONS

Patent Abstracts of Japan, vol. 15, No. 206 (C–835) May 27, 1991 of JP–A–03 056 632 (Furakawa).

Patent Abstracts of Japan, vol. 15, No. 206 (C–835) May 27, 1994 of JP–A–03 056 633 (Furukawa).

*Primary Examiner*—George Wyszomierski

*Attorney, Agent, or Firm*—Frishauf, Holtz, Goodman, Langer & Chick, P.C.

[57] ABSTRACT

A wire for electric railways comprises a copper alloy which consists essentially, by weight percent, of 0.1 to 1.0% Cr, 0.01 to 0.3% Zr, 0.05 to 0.15% Sn, and 10 ppm or less O, and if required, further contains 0.01 to 0.1% Si, or 0.01 to 0.1% Si and 0.001 to 0.05% Mg, with the balance being Cu and inevitable impurities.

18 Claims, 1 Drawing Sheet

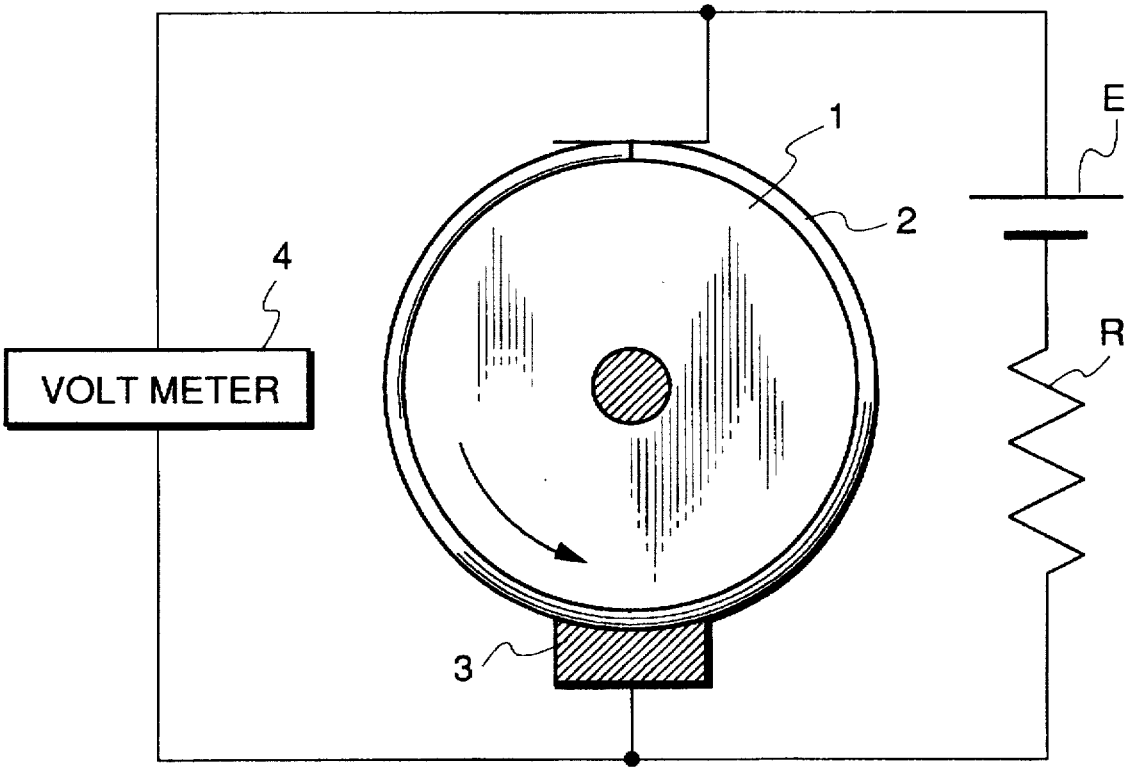
1
2
E
4
VOLT METER
R
3

WIRE FOR ELECTRIC RAILWAYS

CROSS-REFERENCE TO RELATED CASES

The present application is a continuation-in-part of application Ser. No. 08/055,205 filed on Apr. 30, 1993, now abandoned, the entire contents of which are hereby incorporated by reference.

BACKGROUND OF THE INVENTION

1. Field of the Invention

This invention relates to a wire for use as overhead lines in electric railways.

2. Prior Art

It is known that overhead lines for electric railways include in general contact wires for supplying electric power to electric rolling stocks, messenger wires for supplementing power to the electric rolling stocks and for supporting the contact wires in the air, and auxiliary messenger wires for supporting the messenger wires.

These wires have conventionally been formed of pure Copper or copper alloys containing 0.3 percent by weight Sn.

As is seen in super-express railways such as the Shinkansen, higher speed performance is increasingly required of electric rolling stocks manufactured in recent years, and an increase in wire tension is required of the wires. Accordingly, wires having higher tension are demanded.

To meet such demand, recently, copper alloy wires containing Cr and Zr and having a fundamental composition of the precipitation hardening type have been proposed for use as a wire having high tension. For example, in Japanese Provisional Patent Publications (Kokai) Nos. 3-56632 and 3-56633, there have been proposed wires each formed of a copper alloy having a chemical composition containing, by weight percent (hereinafter referred to "%"), 0.001 to 0.35% Zr, and 0.01 to 1.2% Cr, and if required, further containing 1.5% or less of at least one element selected from the group consisting of 0.3% or less Mg, 1.5% or less Zn, 0.2% or less Ag, 0.5% or less Cd, and the balance of Cu and inevitable impurities including Sn, Si, P, Fe, Ni, Pb, As, Sb, Bi and Si whose contents are limited as follows: Sn: 100 ppm or less; Si: 50 ppm or less; P: 50 ppm or less; Fe: 100 ppm or less; Ni: 100 ppm or less; Pb: 20 ppm or less; As: 20 ppm or less; Sb: 20 ppm or less; Bi: 20 ppm or less; and Si: 10 ppm or less.

These wires formed of the copper alloys containing Cr and Zr are manufactured in the following manner: First, a copper alloy ingot having a predetermined composition is prepared, and the prepared alloy ingot is hot rolled or hot extruded at a temperature of 700° to 850° C. to produce a roughly rolled coil of pure copper or a copper alloy having a large diameter and a short length, followed by solution treatment thereof. Thereafter, cold drawing and aging treatment are repeated, to thereby effect wire drawing to a predetermined size. Thus, the wires are manufactured (see Japanese Patent Publications (Kokoku) Nos. 60-53739, 63-3936, etc.)

In recent years, however, it is not unusual for newly manufactured electric rolling stocks to have a speed as high as 350 kph or more. Accordingly, in order to ensure stable sliding contact of a pantograph of an electric rolling stock with a contact wire, it is required that the wire tension of the contact wire and the messenger wire be made larger than conventional wires and the wires of a contact line (formed of a contact wire, a messenger wire, and an auxiliary messenger wire) be made lighter in view of the wave propagation velocity. However, none of the above-mentioned known wires are fully satisfactory in tensile strength, and therefore, wires having higher mechanical strength have been desired.

More specifically, in conventional wires of a contact line which were previously formed of a copper contact wire and a messenger wire of a hard copper strand, a steel-cored copper contact wire having the same cross sectional area as the conventional copper contact wire has been used in place of the copper contact wire in recent years. As a result, the power-feeding capacity of the contact wire has decreased, whereby the messenger wire is required to share an increased rate of feeding of electric power (by about 60% or larger) than before to compensate for the decreased power-feeding capacity of the contact wire. Further, in these years, the power consumption per electric rolling stock has increased in electric railways, and the number of electric rolling stocks has also been increased.

On the other hand, since electric rolling stocks run faster, it is required that the whole wires of contact line be made lighter in weight in order that electric rolling stocks can stably collect power, in view of the wave propagation velocity. Messenger wires have thus been rendered smaller in diameter, e.g. a messenger wire formed of 7 fine wires each having a diameter of 4.3 mm has been replaced by one formed of 7 fine wires each having a diameter of 3.7 mm. Accordingly, since a larger amount of current than before flows through the messenger wire, the amount of heat generation thereof has become larger. To cope with the above problems, materials for messenger wires are demanded, which have desirable tensile strength as well as in thermal creep resistance up to 200° C. or 300° C.

Messenger wires are maintained taut by their own tension obtained by weights having a weight of about 1000 kg and vertically hung at both ends of the wire. However, as electric rolling stocks pass, a repeated bending stress is applied to the ends of the wire. If the stress applied to the ends occurs tens of thousands of times, rupture would occur at the ends of the wire. Therefore, ends of messenger wires are required to withstand in 90 degree repeated bending properties.

Further, a wire which is poor in pressure weldability suffers from rupture at a pressure welded portion thereof or in the vicinity thereof. Furthermore, if the tensile strength at the pressure welded portion is low, the wire is sometimes cut at the pressure welded portion, which can cause an accident.

SUMMARY OF THE INVENTION

It is therefore the object of the invention to provide a wire for use in electric railways, which is formed of a copper alloy having a desirable pressure weldability, and is much superior to conventional wires in resistance to wear in sliding contact with a wire while collecting current (hereinafter referred to as "current-collecting sliding wear resistance") as well as in tensile strength.

To attain the object, the present invention provides a wire for an electric railway, comprising a copper alloy consisting essentially, by weight percent, of 0.1 to 1.0% Cr, 0.01 to 0.3% Zr, 0.05 to 0.15% Sn, 10 ppm or less O, and the balance of Cu and inevitable impurities.

The copper alloy may further contain 0.01 to 0.1 Si, or 0.01 to 0.1% Si and 0.001 to 0.05% Mg, if required.

The above and other objects, features and advantages of the invention will be more apparent from the ensuring detailed description.

BRIEF DESCRIPTION OF THE DRAWING

The single FIGURE is a schematic view showing a device for measuring current-collecting sliding wear resistance properties of wires.

DETAILED DESCRIPTION

Under the aforementioned circumstances, the present inventors have made studies in order to obtain a wire for electric railways, which has desirable pressure welding strength, current-collecting sliding wear resistance, high-temperature creep properties, and other mechanical strength such as tension of the wires, and as a result, have reached the following finding:

If in a wire for electric railways, which comprises a copper alloy containing 0.1 to 1.0% Cr, 0.01 to 0.3% Zr, and 0.05 to 0.15% Sn, and if required, further containing 0.01 to 0.1% Si, or 0.01 to 0.1% Si and 0.001 to 0.05% Mg, with the balance being Cu and inevitable impurities, the oxygen content is reduced to 10 ppm or less, the current-collecting sliding wear resistance as well as the tensile strength of the wire are increased, and further, pressure weldability thereof is also improved.

The present invention is based upon the above finding.

Therefore, the wire for electric railways according to the invention comprises a copper alloy consisting essentially of 0.1 to 1.0% Cr, 0.01 to 0.3% Zr, 0.05 to 0.15% Sn, and 10 ppm or less 0, and if required, further containing 0.01 to 0.1% Si, or 0.01 to 0.1% Si and 0.001 to 0.05% Mg, and the balance of Cu and inevitable impurities.

To manufacture the wire for electric railways according to the invention, first a billet of copper containing oxygen in a very small amount is prepared, followed by rolling the thus prepared billet into element wires. Generally, it is technically possible to prepare billets containing oxygen in an amount of 10 ppm or less in small quantities by the use of a vacuum melting furnace on a laboratory basis. However, it is difficult to manufacture the above billets by the vacuum melting furnace on a mass production basis, resulting in high costs. According to the invention, this problem has been solved by manufacturing a copper alloy billet to be formed into wires in the following manner: A reducing gas is blown through a graphite nozzle into a molten copper obtained by melting ordinary oxygen-free copper. During blowing of the reducing gas, copper oxide is temporarily added thereto, followed by further blowing the reducing gas, thereby preparing a molten copper containing oxygen in such a very small amount of 10 ppm or less. Then, Cr, and further Zr, Sn, and if required, Si or Si and Mg are added in respective predetermined amounts to the molten copper containing oxygen in such a very small amount. The resulting molten alloy is cast into a cylindrical or a prismatic billet. The above-mentioned method of adding copper oxide to molten copper during blowing of a reducing gas into the molten copper to thereby reduce the oxygen content to 10 ppm or less was heretofore not known and is advantageously capable of producing in large quantities molten copper containing oxygen in a very small amount.

The billet thus produced is subjected to hot working by heating preferably under a reducing atmosphere at a temperature of 860° to 1000° C. and at a draft of 90% or more per one time of hot working, to thereby produce an element wire. Before the thus produced element wire is cooled to 860° C. or below, the element wire is water cooled or quenched by gas. Alternatively, the element wire is allowed to cool in air after being subjected to the hot working, followed by solution treatment including again heating at 860° to 1000° C. for 0.1 to 6 hours and then quenching. Further, after repeated cold working, an aging treatment is performed, or alternatively cold working and an aging treatment are alternately repeated, thereby manufacturing a wire having a predetermined cross sectional area.

The draft employed in the above-mentioned cold working is preferably 40% or more at one time, and more preferably, the draft in the last cold working is 70% or more. The temperature of the aging treatment is preferably in the range of 350° to 600° C. In the repeated cold working and aging treatment which are each carried out at least twice, it is more preferable that the temperature of the last aging treatment be lower than the temperature of the preceding aging treatment (s).

The contents of the components of the copper alloy forming the wire for an electric railway according to the invention have been limited as previously stated for the following reasons:

(a) Cr and Zr:

Both of Cr and Zr are present in the Cu basis in the form of particles dispersed therein, and act to improve the wear resistance and the heat resisting strength. However, when the Cr content exceeds 1.0%, or the Zr content exceeds 0.3%, the dispersed particles become coarser to thereby decrease the strength at a pressure welded portion of the finished wire formed from the alloy. As a result, the arcing rate unfavorably increases, thereby degrading the current-collecting sliding wear resistance. On the other hand, when the Cr content is below 0.1%, or the Zr content is below 0.01%, the above action cannot be performed to a desired extent. Therefore, the contents of Cr and Zr are limited to the ranges of 0.1 to 1.0% and 0.01 to 0.3%, respectively. Preferably, the Cr content should be limited to a range of 0.15 to 0.50%, and the Zr content a range of 0.05 to 0.25%, respectively.

(b) Sn:

Sn acts to decrease the abrasion loss of the wire caused by high speed traveling of the electric rolling stock. However, when the Sn content is below 0.05%, the above action cannot be performed to a desired extent. On the other hand, when the Sn content exceeds 0.15%, the electric conductivity of the wire decreases. Therefore, the Sn content is limited to the range of 0.05 to 0.15%. Preferably, the Sn content should be limited to a range of 0.07% to 0.12%.

(c) Si:

Si acts to improve the tensile strength and the pressure welding strength, and further to increase the sliding wear resistance. However, when the Si content is below 0.01%, the above action cannot be performed to a desired extent. On the other hand, when the Si content exceeds 0.1%, the electric conductivity decreases. Therefore, the Si content is limited to the range of 0.01 to 0.1%. Preferably, the Si content should be limited to a range of 0.01 to 0.05%.

(d) Mg:

Mg, like Si, acts to improve the sliding wear resistance. However, when the Mg content is below 0.001%, the above action cannot be performed to a desired extent, whereas when the Mg content exceeds 0.05%, it will result in degraded conformability between the wire and a current-collecting plate. Therefore, the Mg content is limited to the range of 0.001 to 0.05%. Preferably, the Mg content should be limited to a range of 0.005 to 0.03%.

(e) Oxygen:

If oxygen is present in an amount of more than 10 ppm, it reacts with Cr, Zr, Sn, Si and Mg to form crystals mainly formed of oxides thereof, the size of which is likely to become 2 μm or larger. When crystals having a size of 2 μm or larger are present in the wire basis, the strength at a pressured welded joint or in the vicinity thereof decreases, causing an increased arcing rate, which can cause heavy damage to the wire. Therefore, the oxygen content is limited to a range of 10 ppm or below. Preferably, the oxygen content should be limited to a range of 7 ppm or less.

An example of the invention will now be explained hereinbelow.

EXAMPLE

AS a starting material, an electrolytic copper containing oxygen in an amount of 20 ppm was charged into a graphite crucible and then melted under an atmosphere of Ar gas. When the temperature of the resulting molten copper became 1200° C., CO gas was continuously blown into the crucible at a flow rate of about 10 liter/min through a graphite nozzle for 10 minutes. Then, 1000 g $Cu_2O$ powder was instantaneously blown through the graphite nozzle, followed by further blowing the CO gas for 10 minutes, thereby preparing a molten copper containing $O_2$ in an amount as small as 10 ppm or less. Added to the thus prepared molten copper were Cr, and further Zr, Sn, Si and Mg while stirring the molten copper, to obtain a molten copper alloy. Then, the thus obtained molten copper alloy was cast into a metallic die, to prepare billet specimens (A) to (X) according to the present invention and comparative billet specimens (a) to (g) each having a size of 250 mm in diameter and 3 m in length and having compositions shown in Tables 1 and 2. The comparative billet specimen (c) which contains $O_2$ in an amount exceeding 10 ppm, and a conventional billet specimen were prepared by the conventional method of blowing CO gas into molten copper through a graphite nozzle.

Billet specimens (A) to (X) of the present invention, comparative billet specimens (a) to (g), and a conventional billet specimen each having a chemical composition shown in Table 1 or 2 were heated to temperatures shown in Tables 3 and 4, and then roughly hot rolled at drafts shown in Tables 3, and 4, followed by allowing them to cool in air. Further, the specimens were heated to temperatures shown in Tables 3 and 4 at which solution treatment was to be conducted, respectively, followed by water cooling to effect solution treatment, thereby producing element wires. Oxides on surfaces of the thus produced element wires were removed, and then first cold drawing was effected so that the surface area of the wire was reduced by 50 %. Thereafter, the resulting wires were charged into a bright annealing furnace to conduct an aging treatment at

TABLE 1

| | CHEMICAL COMPOSITION | | | | | | |
|---|---|---|---|---|---|---|---|
| SPECIMEN | Cr (wt %) | Zr (wt %) | Sn (wt %) | Si (wt %) | Mg (wt %) | O (ppm) | Cu AND INEVITABLE IMPURITIES |
| BILLETS OF PRESENT INVENTION | | | | | | | |
| A | 0.12 | 0.18 | 0.07 | — | — | 3 | BALANCE |
| B | 0.23 | 0.28 | 0.09 | — | — | 3 | BALANCE |
| C | 0.31 | 0.15 | 0.08 | — | — | 5 | BALANCE |
| D | 0.52 | 0.12 | 0.10 | — | — | 5 | BALANCE |
| E | 0.45 | 0.09 | 0.12 | — | — | 6 | BALANCE |
| F | 0.73 | 0.11 | 0.06 | — | — | 4 | BALANCE |
| G | 0.95 | 0.03 | 0.13 | — | — | 4 | BALANCE |
| H | 0.25 | 0.08 | 0.05 | 0.02 | — | 6 | BALANCE |
| I | 0.78 | 0.12 | 0.09 | 0.02 | — | 7 | BALANCE |
| J | 0.17 | 0.25 | 0.11 | 0.03 | — | 5 | BALANCE |
| K | 0.82 | 0.03 | 0.08 | 0.04 | — | 4 | BALANCE |
| L | 0.12 | 0.08 | 0.09 | 0.06 | — | 4 | BALANCE |
| M | 0.20 | 0.09 | 0.12 | 0.08 | — | 6 | BALANCE |
| N | 0.54 | 0.13 | 0.13 | 0.09 | — | 5 | BALANCE |
| O | 0.35 | 0.08 | 0.06 | 0.03 | 0.002 | 4 | BALANCE |
| P | 0.36 | 0.10 | 0.08 | 0.02 | 0.012 | 4 | BALANCE |
| Q | 0.29 | 0.10 | 0.07 | 0.03 | 0.043 | 5 | BALANCE |

TABLE 2

| | CHEMICAL COMPOSITION | | | | | | |
|---|---|---|---|---|---|---|---|
| SPECIMEN | Cr (wt %) | Zr (wt %) | Sn (wt %) | Si (wt %) | Mg (wt %) | O (ppm) | Cu AND INEVITABLE IMPURITIES |
| BILLETS OF PRESENT INVENTION | | | | | | | |
| R | 0.33 | 0.11 | 0.10 | 0.05 | 0.03 | 6 | BALANCE |
| S | 0.30 | 0.09 | 0.15 | 0.06 | 0.011 | 3 | BALANCE |
| T | 0.31 | 0.10 | 0.11 | 0.05 | 0.038 | 5 | BALANCE |
| U | 0.12 | 0.28 | 0.13 | 0.08 | 0.021 | 3 | BALANCE |
| V | 0.38 | 0.07 | 0.06 | — | — | 10 | BALANCE |
| W | 0.88 | 0.25 | 0.07 | — | — | 8 | BALANCE |
| X | 0.21 | 0.10 | 0.10 | — | — | 9 | BALANCE |
| COMPARATIVE BILLETS | | | | | | | |
| a | 0.35 | 0.09 | 0.03* | 0.03 | 0.004 | 5 | BALANCE |
| b | 0.15 | 0.25 | 0.18* | 0.07 | 0.019 | 3 | BALANCE |
| c | 0.38 | 0.07 | 0.06 | 0.07 | 0.043 | 12* | BALANCE |
| d | 1.2* | 0.04 | 0.12 | — | — | 5 | BALANCE |
| e | 0.05* | 0.27 | 0.12 | 0.08 | 0.021 | 4 | BALANCE |
| f | 0.24 | 0.4* | 0.09 | — | — | 4 | BALANCE |
| g | 9.78 | 0.005* | 0.09 | 0.05 | — | 5 | BALANCE |
| CONVENTIONAL BILLET | 0.23 | 0.20 | —* | 0.0006 | 0.10 | 18* | BALANCE |

NOTE: Symbol * indicates a value outside the range according to the present invention.

460° C. for 2 hours, and then second cold drawing was effected so that the surface area of the wire was reduced by 85%. Further, the resulting wires were again charged into the bright annealing furnace to conduct aging treatment at 440° C. for two hours, thereby preparing wire specimens according to the present invention Nos. 1 to 24, comparative wire specimens Nos. 1 to 7, and a conventional wire specimen.

These wire specimens were measured in respect of tensile strength at a portion other than a pressure welded portion thereof and that at the pressure welded portion by a method according to JIS E 2101. With respect to the strength at the pressure welded portion, specimens having a pressure welded portion with a tensile strength 95% or more of the tensile strength at the other portion was classified as A, those having a pressure welded portion with a tensile strength not smaller than 85% but smaller than 95% of the tensile strength at the other portion as B, and those having a pressure welded portion with a tensile strength less than 85% of the tensile strength at the other portion as C, respectively. The measurement results are shown in Table 3. Further, the electric conductivity of each of the wires was measured over a length of 1 m by a double bridge method according to JIS C 3001, and still further, the wear resistance current-collecting sliding was measured by means of a device shown in the single FIGURE.

In the FIGURE, reference numeral 1 designates a rotor, 2 a wire to be tested, 3 a current-collecting plate (slider), and 4 a volt meter, respectively.

As the wire 2 in the FIGURE, each of the wire specimens Nos. 1 to 24 of the present invention, the comparative wire specimens Nos. 1 to 7, and the conventional wire was wound around the rotor 1 having a diameter of 50 cm. On the other hand, the current collecting plate 3 comprised of an iron slider for pantograph (Model M-39®, manufactured by Mitsubishi Materials Corporation, Japan, for example) was pressured against the wire at a pressuring force of 2 kgf, and the rotor 1 was rotated at a peripheral speed of 15 kph for 60 minutes while applying a direct current of 20A and 100 V to the plate 3. Thus, the current-collecting sliding wear properties of the wires, e.g. the wear rate of the current collecting plate, the wear rate of the wire cross sectional area, the arcing rate, etc., were measured. The measurement results are shown in Tables 3 and 4. The wear rate of the current-collecting plate was obtained by converting the rotating speed of the rotor into a distance value, and then dividing the decrease in the weight of the current-collecting plate by the distance value. The wear rate of the wire cross sectional area was obtained by accurately measuring the diameter of the wire after the test by means of a micrometer, and then dividing the decrease in the diameter by the value of the rotating speed. Further, a potential difference of 10 to 20 V is generated at the time of arcing. Therefore, when a potential difference of 6 V to 50 V inclusive was generated, it was regarded that arcing occurred, and when a test was conducted on the current-collecting sliding wear, the potential difference was measured at every two minutes for ten seconds by means of a volt meter. The thus measured values were continuously recorded in a chart to obtain an arcing time period, and the percentage of the arcing time period in the above 10 seconds was determined as an arcing rate.

Further, with respect to the wire specimens Nos. of the present invention Nos. 1 to 24, the comparative wire specimen Nos. 1 to 7, and the conventional wire specimen, a high-temperature creep rupture test was conducted by applying a load of 15 kgf/mm$^2$ and a load of 30 kgf/mm$^2$ to the specimen each at 200° C. for 2000 hours to measure a time period from the start of the test until occurrence of a rupture. The results are shown in Tables 3 and 4.

Still further, each of the wire specimens Nos. of the present invention 1 to 24, the comparative wire specimens Nos. 1 to 7, and the conventional wire specimen was bent by 90 degrees from a vertical position to a horizontal position and then returned to the original or vertical position (first bending). Next, each of the wire specimens was bent by 90 degrees from the original vertical direction to a horizontal direction opposite to that of the first bending and then returned to the original vertical position (second bending). The first and second bendings were counted as two. The above bending operations were repeated until a rupture occurred, and the number of times of bending operations was counted. The results are shown in Tables 3 and 4.

Still further, each of the wire specimens Nos. 1 to 24 of the present invention, the comparative wire specimens Nos. 1 to 7, and the conventional wire specimen each having a length of 1 m was twisted by 180 degrees in the circumferential direction (first twisting), and each of the twisted specimens was returned to the original position (second twisting). The first and second twistings were counted as two. The above twisting operations were repeated until a rupture occurred, and the number of times of twisting operations was counted. The results are also shown in Tables 3 and 4.

As is apparent from Tables 1 to 4, the wire specimens Nos. 1 to 24 of the present invention are more desirable than the conventional wire specimen in all of pressure welding strength, current-collecting sliding wear properties, high-temperature creep strength, and other mechanical strength. However, it is learned from the tables that the comparative wire specimens Nos. 1 to 7, which each have at least one of the component elements having a content falling outside the range of the present invention, are inferior in one of the above-mentioned properties to the wires of the present invention.

TABLE 3

| SPECIMEN | BILLET | HOT WORKING CONDITIONS HEATING TEMPERATURE (°C.) | HOT WORKING CONDITIONS DRAFT (%) | SOLUTION TREATMENT TEMPERATURE (°C.) | TENSILE STRENGTH AT PORTION OTHER THAN PRESSURE WELD (kg/mm$^2$) | ELECTRIC CONDUCTIVITY (% IACS) | BENDING TIME NUMBER | TWISTING TIME NUMBER |
|---|---|---|---|---|---|---|---|---|
| WIRES OF PRESENT INVENTION | | | | | | | | |
| 1 | A | 930 | 99 | 925 | 64.6 | 81.4 | 17 | 520 |
| 2 | B | 930 | 99 | 925 | 63.5 | 79.5 | 19 | 540 |
| 3 | C | 930 | 99 | 925 | 65.5 | 81.7 | 19 | 540 |

TABLE 3-continued

| | | | | | | | | |
|---|---|---|---|---|---|---|---|---|
| 4 | D | 930 | 99 | 925 | 63.3 | 82.0 | 20 | 525 |
| 5 | E | 930 | 99 | 925 | 64.4 | 82.2 | 21 | 550 |
| 6 | F | 930 | 99 | 925 | 62.8 | 80.3 | 20 | 535 |
| 7 | G | 930 | 99 | 925 | 64.3 | 79.3 | 17 | 550 |
| 8 | H | 920 | 99 | 930 | 62.4 | 80.8 | 19 | 545 |
| 9 | I | 920 | 99 | 930 | 64.2 | 79.7 | 20 | 505 |
| 10 | J | 920 | 99 | 930 | 64.9 | 81.2 | 17 | 550 |
| 11 | K | 920 | 99 | 930 | 65.9 | 79.8 | 22 | 560 |
| 12 | L | 920 | 99 | 930 | 62.1 | 80.6 | 18 | 535 |
| 13 | M | 920 | 99 | 930 | 64.0 | 82.6 | 21 | 545 |
| 14 | N | 920 | 99 | 930 | 65.6 | 81.7 | 18 | 540 |
| 15 | O | 930 | 99 | 950 | 64.7 | 81.7 | 18 | 520 |
| 16 | P | 930 | 99 | 950 | 64.4 | 82.3 | 22 | 540 |
| 17 | Q | 930 | 99 | 950 | 63.4 | 80.7 | 22 | 530 |

| | | HIGH TEMP. CREEP RUPTURE TEST AT 200° C. TIME PERIOD: 2000 HR | | CURRENT-COLLECTING SLIDING WEAR PROPERTIES | | |
|---|---|---|---|---|---|---|
| SPECIMEN | PRESSURE WELDING STRENGTH | LOAD 15 kgf/mm² | LOAD 30 kgf/mm² | WEAR RATE OF CURRENT COLLECTING PLATE (mg/10 km) | WEAR RATE OF WIRE CROSS SECTIONAL $\times 10^{-4}$ mm²/test | ARCING RATE (%) |
| WIRES OF PRESENT INVENTION | | | | | | |
| 1 | A | NO RUPTURE | NO RUPTURE | 116.9 | 7 | 5.2 |
| 2 | A | NO RUPTURE | NO RUPTURE | 111.3 | 4 | 6.2 |
| 3 | A | NO RUPTURE | NO RUPTURE | 117.8 | 5 | 5.3 |
| 4 | A | NO RUPTURE | NO RUPTURE | 116.7 | 6 | 3.4 |
| 5 | A | NO RUPTURE | NO RUPTURE | 121.5 | 7 | 5.7 |
| 6 | A | NO RUPTURE | NO RUPTURE | 124.3 | 6 | 4.1 |
| 7 | A | NO RUPTURE | NO RUPTURE | 115.6 | 5 | 6.3 |
| 8 | A | NO RUPTURE | NO RUPTURE | 120.2 | 5 | 3.6 |
| 9 | A | NO RUPTURE | NO RUPTURE | 102.2 | 5 | 4.9 |
| 10 | A | NO RUPTURE | NO RUPTURE | 106.5 | 4 | 3.6 |
| 11 | A | NO RUPTURE | NO RUPTURE | 120.2 | 6 | 4.8 |
| 12 | A | NO RUPTURE | NO RUPTURE | 125.9 | 5 | 3.4 |
| 13 | A | NO RUPTURE | NO RUPTURE | 123.3 | 6 | 6.2 |
| 14 | A | NO RUPTURE | NO RUPTURE | 104.6 | 4 | 4.3 |
| 15 | A | NO RUPTURE | NO RUPTURE | 125.1 | 6 | 5.8 |
| 16 | A | NO RUPTURE | NO RUPTURE | 114.0 | 5 | 6.5 |
| 17 | A | NO RUPTURE | NO RUPTURE | 112.3 | 4 | 3.7 |

TABLE 4

| | | HOT WORKING CONDITIONS | | SOLUTION TREAT- | TENSILE STRENGTH AT PORTION | | | |
|---|---|---|---|---|---|---|---|---|
| SPECIMEN | BILLET | HEATING TEMPERATURE (°C.) | DRAFT (%) | MENT TEMPERATURE (°C.) | OTHER THAN PRESSURE WELD (kg/mm²) | ELECTRIC CONDUCTIVITY (% IACS) | BENDING TIME NUMBER | TWISTING TIME NUMBER |
| WIRES OF PRESENT INVENTION | | | | | | | | |
| 18 | R | 930 | 99 | 950 | 65.4 | 80.2 | 21 | 525 |
| 19 | S | 930 | 99 | 950 | 64.1 | 81.1 | 20 | 515 |
| 20 | T | 930 | 99 | 950 | 63.8 | 81.2 | 21 | 510 |
| 21 | U | 935 | 99 | 940 | 62.9 | 82.3 | 19 | 520 |
| 22 | V | 935 | 99 | 940 | 64.1 | 81.7 | 22 | 525 |
| 23 | W | 935 | 99 | 940 | 63.9 | 79.8 | 18 | 550 |
| 24 | X | 935 | 99 | 940 | 62.2 | 81.4 | 20 | 525 |
| COMPARATIVE WIRES | | | | | | | | |
| 1 | a | 930 | 99 | 950 | 61.1 | 82.2 | 17 | 540 |
| 2 | b | 935 | 99 | 940 | 62.3 | 72.6 | 15 | 480 |
| 3 | c | 935 | 99 | 940 | 58.9 | 81.4 | 13 | 475 |

TABLE 4-continued

| | | | | | | | | |
|---|---|---|---|---|---|---|---|---|
| 4 | d | 930 | 99 | 925 | 60.4 | 77.5 | 15 | 505 |
| 5 | e | 935 | 99 | 940 | 55.7 | 83.7 | 19 | 515 |
| 6 | f | 930 | 99 | 925 | 62.2 | 81.8 | 18 | 520 |
| 7 | g | 920 | 99 | 930 | 63.7 | 80.3 | 19 | 520 |
| CONVENTIONAL WIRES | CONVENTIONAL BILLET | 750 | 99 | 800 | 45.3 | 88.7 | 7 | 380 |

| | | | | CURRENT-COLLECTING SLIDING WEAR PROPERTIES | | |
|---|---|---|---|---|---|---|
| | PRESSURE | HIGH TEMP. CREEP RUPTURE TEST AT 200° C. TIME PERIOD: 2000 HR | | | | |
| SPECIMEN | WELDING STRENGTH | LOAD 15 kgf/mm² | LOAD 30 kgf/mm² | WEAR RATE OF CURRENT COLLECTING PLATE (mg/10 km) | WEAR RATE OF WIRE CROSS SECTIONAL AREA $\times 10^{-4}$ mm²/test | ARCING RATE (%) |
| WIRES OF PRESENT INVENTION | | | | | | |
| 18 | A | NO RUPTURE | NO RUPTURE | 119.4 | 7 | 5.4 |
| 19 | A | NO RUPTURE | NO RUPTURE | 126.7 | 5 | 3.5 |
| 20 | A | NO RUPTURE | NO RUPTURE | 118.6 | 6 | 6.3 |
| 21 | A | NO RUPTURE | NO RUPTURE | 101.2 | 6 | 5.2 |
| 22 | B | NO RUPTURE | NO RUPTURE | 124.1 | 6 | 5.1 |
| 23 | A | NO RUPTURE | NO RUPTURE | 103.7 | 5 | 5.7 |
| 24 | A | NO RUPTURE | NO RUPTURE | 100.5 | 7 | 3.6 |
| COMPARATIVE WIRES | | | | | | |
| 1 | A | NO RUPTURE | NO RUPTURE | 154.7 | 10 | 11.8 |
| 2 | B | 1608 | 1280 | 120.5 | 7 | 4.7 |
| 3 | C | 1402 | 1008 | 195.2 | 14 | 9.8 |
| 4 | C | 1510 | 1310 | 212.8 | 16 | 16.2 |
| 5 | A | 1820 | 1682 | 153.1 | 8 | 6.7 |
| 6 | B | 1610 | 1358 | 180.5 | 11 | 9.6 |
| 7 | A | NO RUPTURE | 1716 | 135.8 | 13 | 4.7 |
| CONVENTIONAL WIRES | C | 1470 | 980 | 167.2 | 10 | 10.4 |

What is claimed is:

1. In a wire for an overhead line for an electric railway, the improvement comprising said wire being formed of a copper alloy consisting essentially, by weight percent, of 0.1 to 1.0% Cr, 0.01 to 0.3% Zr, 0.05 to 0.15% Sn, 0.01 to 0.1% Si, 10 ppm or less O, and the balance of Cu and inevitable impurities, and the wire having an electrical conductivity of at least about 80% IACS.

2. The wire for an overhead line for an electric railway as claimed in claim 1, consisting, by weight percent, of 0.15% to 0.50% Cr, 0.05% to 0.25% Zr, 0.07 to 0.12% Sn, 0.01 to 0.05% Si, 7 ppm or less O, and the balance of Cu and inevitable impurities.

3. The wire for an overhead line for an electric railway, as claimed in claim 1, wherein the copper alloy consists of 0.25 weight % Cr, 0.08 weight % Zr, 0.05 weight % Sn, 0.02 weight % Si, 6 ppm O and the balance being Cu and inevitable impurities.

4. The wire for an overhead line for an electric railway, as claimed in claim 1, wherein the copper alloy consists of 0.78 weight % Cr, 0.12 weight % Zr, 0.09 weight % Sn, 0.02 weight % Si, 7 ppm O and the balance being Cu and inevitable impurities.

5. The wire for an overhead line for an electric railway, as claimed in claim 1, wherein the copper alloy consists of 0.17 weight % Cr, 0.25 weight % Zr, 0.11 weight % Sn, 0.03 weight % Si, 5 ppm O and the balance being Cu and inevitable impurities.

6. The wire for an overhead line for an electric railway, as claimed in claim 1, wherein the copper alloy consists of 0.82 weight % Cr, 0.03 weight % Zr, 0.08 weight % Sn, 0.04 weight % Si, 4 ppm O and the balance being Cu and inevitable impurities.

7. The wire for an overhead line for an electric railway, as claimed in claim 1, wherein the copper alloy consists of 0.12 weight % Cr, 0.08 weight % Zr, 0.09 weight % Sn, 0.06 weight % Si, 4 ppm O and the balance being Cu and inevitable impurities.

8. The wire for an overhead line for an electric railway, as claimed in claim 1, wherein the copper alloy consists of 0.20 weight % Cr, 0.09 weight % Zr, 0.12 weight % Sn, 0.08 weight % Si, 6 ppm O and the balance being Cu and inevitable impurities.

9. The wire for an overhead line for an electric railway, as claimed in claim 1, wherein the copper alloy consists of 0.54 weight % Cr, 0.13 weight % Zr, 0.13 weight % Sn, 0.09 weight % Si, 5 ppm O and the balance being Cu and inevitable impurities.

10. In a wire for an overhead line for an electric railway, the improvement comprising said wire being formed of a copper alloy consisting essentially, by weight percent, of 0.1 to 1.0% Cr, 0.01 to 0.3% Zr, 0.05 to 0.15% Sn, 0.01 to 0.1% Si, 0.001 to 0.05% Mg, 10 ppm or less O, and the balance of Cu and inevitable impurities, and the wire having an electrical conductivity of at least about 80% IACS.

11. The wire for an overhead line for an electric railway, as claimed in claim 10, consisting, by weight percent, of 0.15% to 0.50% Cr, 0.05% to 0.25% Zr, 0.07 to 0.12% Sn, 0.01 to 0.05% Si, 0.005 to 0.03% Mg, 7 ppm or less O, and the balance of Cu and inevitable impurities.

12. The wire for an overhead line for an electric railway, as claimed in claim 10, wherein the copper alloy consists of 0.35 weight % Cr, 0.08 weight % Zr, 0.06 weight % Sn, 0.03 weight % Si, 0.002 weight % Mg, 4 ppm O and the balance being Cu and inevitable impurities.

13. The wire for an overhead line for an electric railway, as claimed in claim 10, wherein the copper alloy consists of 0.36 weight % Cr, 0.10 weight % Zr, 0.08 weight % Sn, 0.02 weight % Si, 0.012 weight % Mg, 4 ppm O and the balance being Cu and inevitable impurities.

14. The wire for an overhead line for an electric railway, as claimed in claim 10, wherein the copper alloy consists of 0.29 weight % Cr, 0.10 weight % Zr, 0.07 weight % Sn, 0.03 weight % Si, 0.043 weight % Mg, 4 ppm O and the balance being Cu and inevitable impurities.

15. The wire for an overhead line for an electric railway, as claimed in claim 10, wherein the copper alloy consists of 0.33 weight % Cr, 0.11 weight % Zr, 0.10 weight % Sn, 0.05 weight % Si, 0.03 weight % Mg, 6 ppm O and the balance being Cu and inevitable impurities.

16. The wire for an overhead line for an electric railway, as claimed in claim 10, wherein the copper alloy consists of 0.30 weight % Cr, 0.09 weight % Zr, 0.15 weight % Sn, 0.06 weight % Si, 0.011 weight % Mg, 3 ppm O and the balance being Cu and inevitable impurities.

17. The wire for an overhead line for an electric railway, as claimed in claim 10, wherein the copper alloy consists of 0.31 weight % Cr, 0.10 weight % Zr, 0.11 weight % Sn, 0.05 weight % Si, 0.038 weight % Mg, 5 ppm O and the balance being Cu and inevitable impurities.

18. The wire for an overhead line for an electric railway, as claimed in claim 10, wherein the copper alloy consists of 0.12 weight % Cr, 0.28 weight % Zr, 0.13 weight % Sn, 0.08 weight % Si, 0.021 weight % Mg, 3 ppm O and the balance being Cu and inevitable impurities.

* * * * *